United States Patent [19]

Zorzi

[11] 4,155,541

[45] May 22, 1979

[54] INSTALLATION FOR RAMMING THE MATERIAL CONSTITUTING THE REFRACTORY LINING OF A METALLURGICAL VESSEL

[75] Inventor: Joseph S. Zorzi, Seraing, Belgium

[73] Assignee: Cockerill, Seraing, Belgium

[21] Appl. No.: 894,274

[22] Filed: Apr. 7, 1978

[30] Foreign Application Priority Data

Apr. 8, 1977 [BE] Belgium ..... 176573

[51] Int. Cl.[2] ..... F27D 1/12

[52] U.S. Cl. ..... 266/281; 264/30

[58] Field of Search ..... 264/30; 266/281, 287

[56] References Cited

U.S. PATENT DOCUMENTS 375,965 1/1888 Versen ..... 264/30

4,094,938 6/1978 Kolpakov et al. ..... 264/30

*Primary Examiner*—Gerald A. Dost

*Attorney, Agent, or Firm*—Sughrue, Rothwell, Mion, Zinn and Macpeak

[57] ABSTRACT

The present invention relates to an installation for ramming the material constituting the refractory lining of a metallurgical vessel.

The ramming installation comprises several ramming elements mounted on an arm horizontally shiftable on a support secured to a column. The column carries a monitoring table above the support and is vertically shiftable on a gantry frame. The gantry frame rolls horizontally relative to the shell of the vessel. The shell of the vessel is mounted on a turntable to which a generally reciprocatory rotary movement is imparted.

4 Claims, 6 Drawing Figures

INSTALLATION FOR RAMMING THE MATERIAL CONSTITUTING THE REFRACTORY LINING OF A METALLURGICAL VESSEL

BACKGROUND OF THE INVENTION

The present invention relates to an installation for ramming the material which constitutes the refractory lining of a metallurgical vessel.

A ramming installation comprises a ramming apparatus which is movable relative to the shell of the metallurgical vessel. The ramming apparatus comprises at least one vertical ramming element provided for ramming refractory material which has previously been poured into the shell of the metallurgical vessel.

THE PRIOR ART

In a first known type of installation, the ramming apparatus is carried by a pivoting crane which can be horizontally brought to a position above the metallurgical vessel (a ladle in the installation under consideration) which is mounted on a stationary support. The boom or jib of the crane carries a separator, to which refractory lining material is fed and which is connected to a dust removing device. In the ramming position the frustoconical separator lies coaxially of the vertical axis of the metal shell of the ladle. Mounted at the lower outlet of the separator is a rotary device which is capable of turning the infrastructure of the installation about the axis of the metal shell of the ladle. The rotary device is downwardly prolonged by a coaxial support arm, which is fast with the rotary device and carries a horizontal telescopic arm at its lower end. On one side the horizontal arm carries a head which pivots about a horizontal axis perpendicular to the radial direction of this arm. In particular, the pivoting head comprises another support arm, which is vertical or slightly inclined and extends downwards. This latter support arm is positioned as a function of the conicity of the metal shell of the ladle, and, in operation, lies between a ramming templet and the shell. On the other side the horizontal arm has a rigid telescopic tube which is connected by a flexible pipe to the passage of the refractory lining material which exists in the rotary device and which communicates with the outlet of the separator.

In a second type of known installation the ramming apparatus is also carried by a pivoting crane, as in the preceding case. Again, similarly, a separator and a rotary device form part of the installation. Similar means for conveying the refractory lining material from the separator to the annular space defined between the ramming templet and the metal shell of the metallurgical vessel (a ladle in this case too) are also provided as in the first case. However, the ramming elements are arranged on two vertical or slightly inclined supporting arms which, in operation, are brought between the templet and the metal shell of the ladle, and are diametrically opposite with respect to the vertical axis of this ladle, which, moreover, remains stationary. The upper ends of the two support arms for the ramming elements are connected to a transverse beam which is equipped with rollers and can run vertically, subject to the effect of a lifting jack, along two vertical guide rods which, in their upper portion, are fixed to a cross-member which is fast with the base of the rotary device.

In a third known type of installation the superstructure is mounted on a fixed frame and can turn horizontally, like a capstan, and pivot in the vertical plane like a rocker. The superstructure itself operates the means for bringing up the refractory lining material. At its front the superstructure carries a ramming head which, in operation, lies vertically above the metallurgical vessel, again constituted by a ladle, which is itself placed on a turntable. The ramming head comprises a cylindrical column whose inclination is variable. This column is held at a specified distance from the metal shell of the ladle and is used for guiding the ramming apparatus with the ramming elements. Furthermore, the ramming apparatus slides in the vertical direction subject to the effect of a crawler carriage, which carries it and is mechanically supported by the above-mentioned column.

In the three known cases ramming is carried out in a single continuous operation between the base of the lining and the upper edge of the ladle by means of a one-piece ramming templet positioned in advance in the metal shell of this ladle. Furthermore, the installation is not provided with any means for controlling the mutual alignment of the ramming elements relative to the radical direction for the purpose of adapting this alignment to the thickness of the refractory lining.

The result of this is that the three known cases do not allow, or only allow with difficulty: the refractory lining of a large number of different vessels to be correctly rammed, these known equipments being rather suitable for the continuous treatment of identical vessels in an ironworks; the refractory lining on the base of the vessels to be formed by tamping; the refractory lining of any vessel to be locally repaired; the ramming of the refractory lining material to be visually monitored as it is carried out such monitoring being of prime importance for controlling the quality of compaction of the rammed refractory lining material; mixed brick/refractory material linings to be obtained; the templets to be lifted as a unit without entailing the risk of damage to the rammed lining.

SUMMARY OF THE INVENTION

Underlying the invention is the object of providing a novel ramming installation by means of which the above drawbacks inherent in the prior art can be remedied.

To this end, in the novel ramming installation, several ramming elements are mounted on an arm which is horizontally shiftable on a support which is fast with a column. The column carries a monitoring table above the support. This column is vertically shiftable on a gantry frame. The gantry frame rolls horizontally relative to the shell of the vessel, which is mounted for rotation about its own axis on a turntable at a constant or variable speed, and to which a generally reciprocatory rotary movement is imparted.

In accordance with the constructional characteristics of the novel ramming installation, the arm which carries the ramming elements pivots about its own centre, while one of its ends bears against the lateral wall of the shell and the other end against the templet. Further, the ends of the arms which carry the ramming elements carry guide rollers which can respectively roll along the side wall of the shell and along the templet.

In order to be able to completely form, and continuously control, the refractory lining of the metallurgical vessel, there is provided, in conjunction with the novel ramming installation, a ramming templet for the side wall of the shell of this metallurgical vessel, this templet being constituted by several mutually superposed segments which rest on the base lining of the vessel and are successively mounted in this vessel as the work of ramming the refractory material of this side wall progresses.

BRIEF DESCRIPTION OF THE DRAWINGS

Further details and features of this invention will become apparent in the course of the description made with reference to the drawings accompanying the present specification, which drawings illustrate, schematically and by way of example only, an embodiment of the invention. In the drawings.

In the various Figures identical elements are designated by the same reference symbols.

DESCRIPTION OF THE PREFERRED EMBODIMENT

Figure 1:
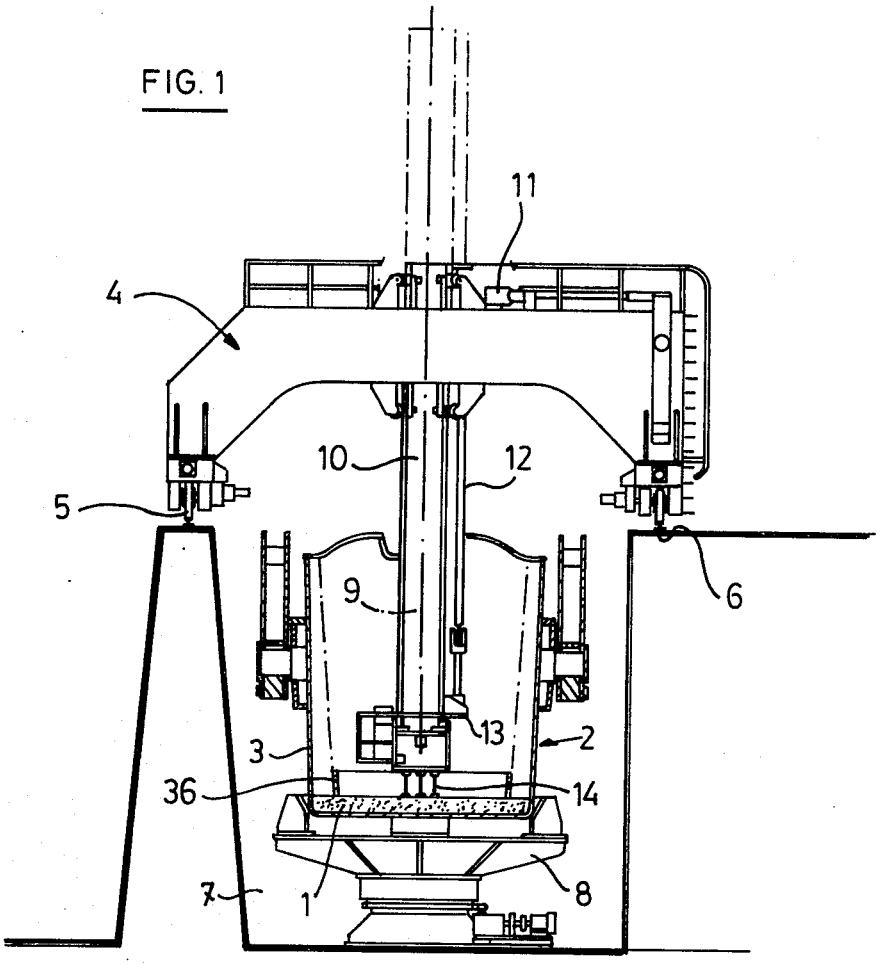
FIG. 1 is a schematic elevational view of an installation according to the invention for ramming the refractory lining material of a metallurgical vessel which, in the case under consideration, is a steel-making or foundry ladle.
Figure 2:
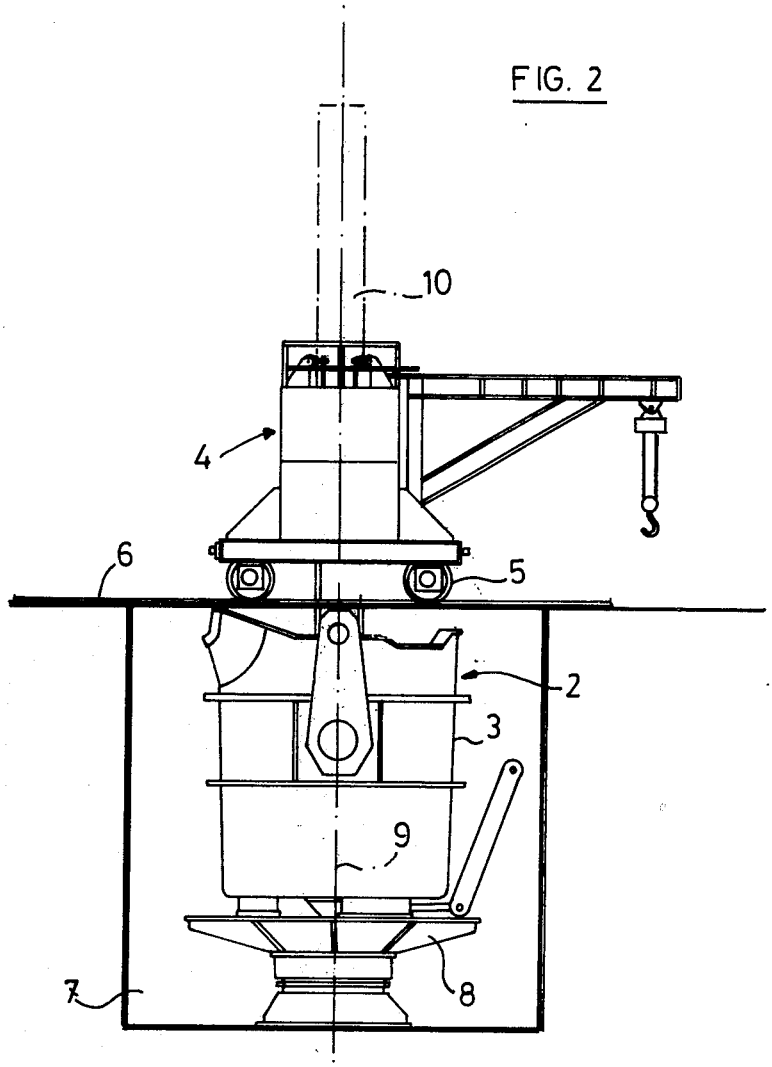
FIG. 2 is a view of the same installation as in FIG. 1, but turned through a right angle.
Figure 3:
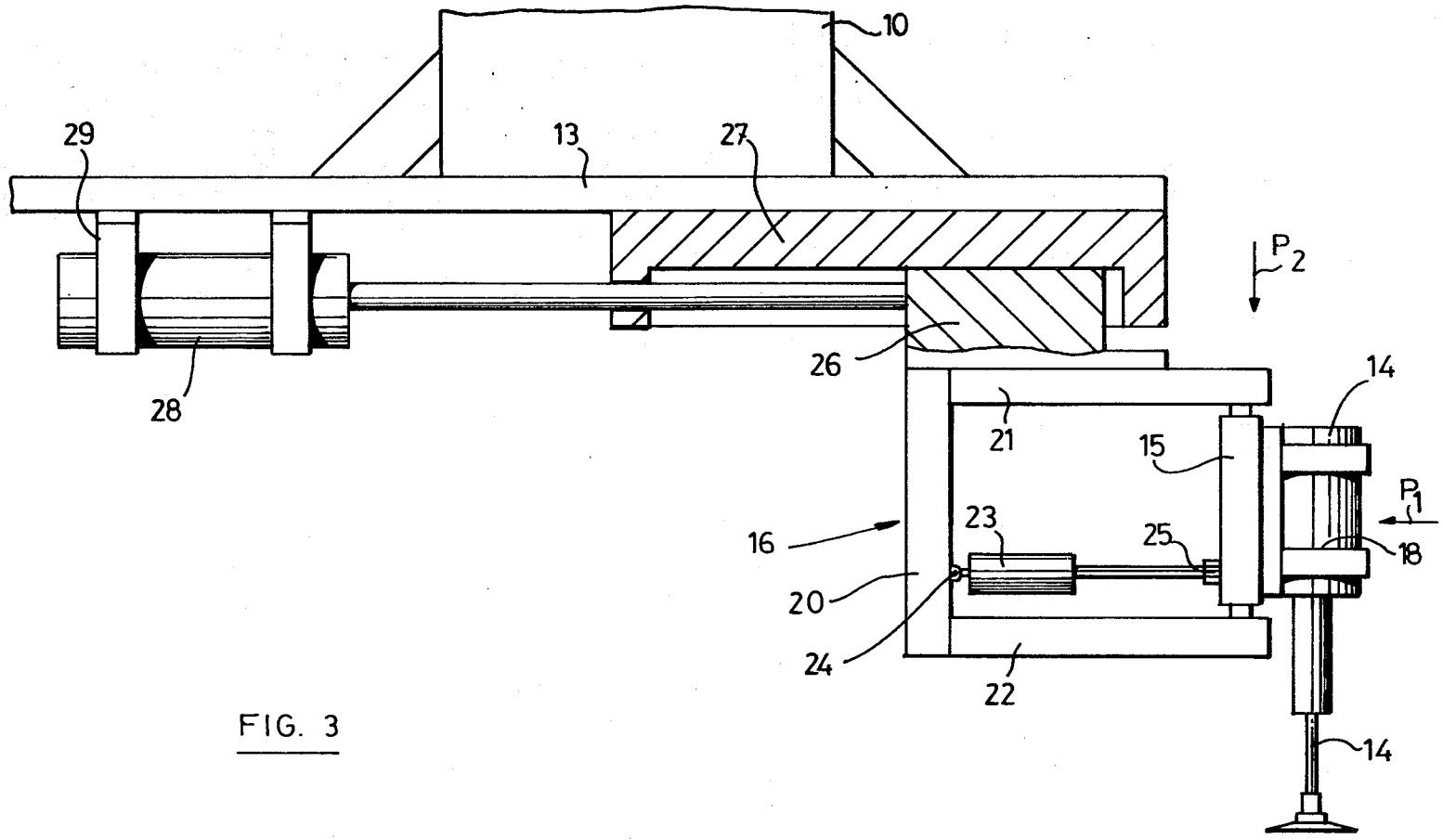
FIG. 3 is a partial vertical cross-section of the ramming installation viewed at the level of the work tools, i.e. the ramming elements.
Figure 4:
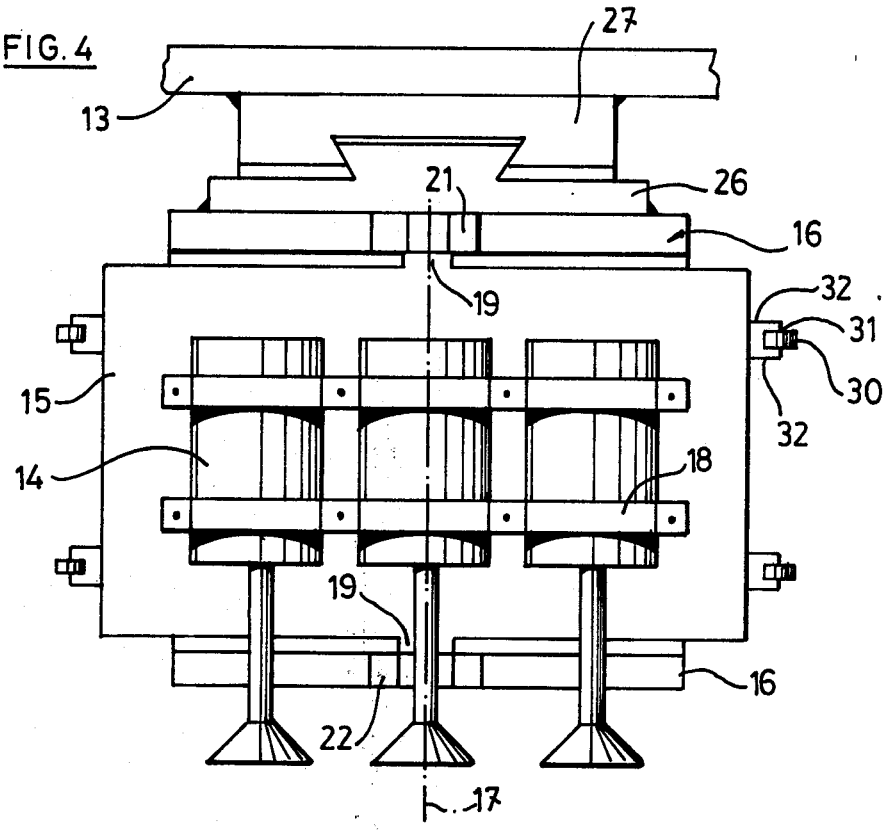
FIG. 4 is an elevational view with partial cross-sectioning, as seen in the direction of the arrow P1 in FIG. 3, illustrating the way in which the ramming elements are mounted in the installation.
Figure 5:
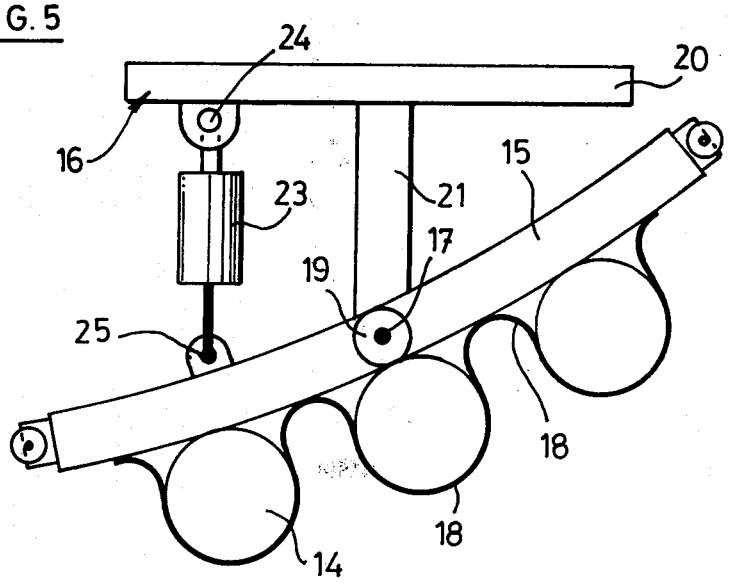
FIG. 5 is a plan view, with partial cross-sectioning, of the ramming elements and of their support, as viewed in the direction of the arrow P2 in FIG. 3.
Figure 6:
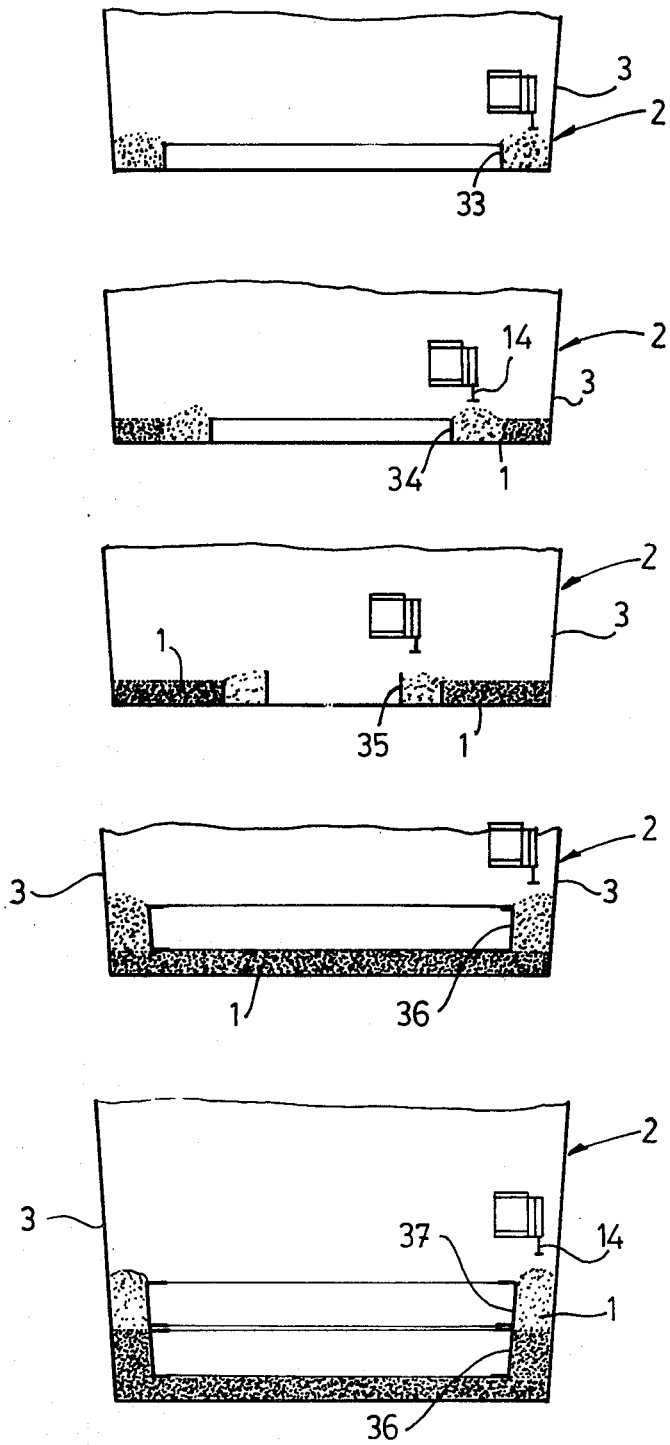
FIG. 6 is in the form of a series of diagrams which illustrate the procedure for ramming a ladle lining by means of the ramming installation.

The illustrated installation is used for ramming the material constituting the refractory lining 1 of a steel-making or foundry ladle 2. The refractory lining 1 is applied inside against the metal shell 3 of the ladle 2. The refractory lining 1 is formed from a refractory lining material whose composition may be constant or variable according to the use to which the ladle 2 is to be put. The ramming installation can be stationary or movable.

In the embodiment under consideration the ramming installation is movable and comprises a gantry frame 4 which is mounted on two sets of wheels 5 which run on fixed rails 6. The gantry frame 4 is movable above a trench 7 in which a turntable 8 is located. The ladle 2 is arranged in the trench 7 on the turntable 8 and lies coaxially of the vertical axis of rotation 9 of the turntable 8. Consequently, in operation, the turntable 8, and, hence, the ladle 2 can simultaneously rotate about the vertical axis 9, normal to the ramming direction, or can be caused to execute a reciprocatory movement enabling a number of successive ramming passes to be carried out, thereby obtaining sufficient compaction of the refractory lining.

As shown in FIG. 1, the gantry frame 4 can move parallel to its own median plane, which passes through the vertical axis 9. The gantry frame 4 carries the ramming apparatus, which can thus be brought above and into the shell 3 of the ladle 2.

More specifically, the ramming apparatus is carried by a vertical column 10 which slides vertically in the gantry frame 4. The vertical movement of the column 10 is controlled by an electric motor 11. The transmission of power from the motor 11 to the column 10 is effected by a worm gear 12 laterally secured along the column 10, and by a complementary toothed wheel (not shown) which meshes with the worm gear 12 and is driven by the motor 11.

Fixed in the lower part of the vertical column 10 is a horizontal monitoring table 13, which carries the various controls for carrying out the movements and operations of the installation, and which covers part of the horizontal section of the ladle 3. Thus, the monitoring table 13 is movable up and down together with the column 10 and with all the ramming apparatus.

The action of ramming the refractory lining material between the ladle 3 and a ramming templet is carried out by means of several vertical ramming elements 14, three for example being provided. The number of ramming elements may vary according to the thickness of the refractory lining 1 to be treated and according to the nature of the refractory lining material used. The ramming elements 14 are all mounted on a common support 15, which can pivot horizontally on a frame 16 about a vertical axis 17 which is fixed relative to the frame 16. In the embodiment described and illustrated the ramming elements 14 are removably mounted on a support 15, for example by means of securing straps 18.

Furthermore, the support 15, constituted by a gently curved plate, carries two central, coaxial pivot pins 19, which align with the axis 17 and turn in bearings (not shown) of the frame 16.

The frame 16 is an element which substantially consists of a vertical web 20 and of two horizontal parallel flanges, the upper flange being designated 21 and the lower flange 22. The ends of the flange 21 and 22 are provided with bearings in which the above-mentioned pivot pins 19 are mounted.

Pivotal movement of the support 15 of the ramming elements 14 is controlled by a pneumatic jack 23, whose body is articulated to a pivot point 24 of the web 20 and whose piston rod is, in its turn, articulated to a pivot point 25 of the support 15.

The upper flange 21 of the frame 16 is secured, e.g. welded, to a slider 26 which slides horizontally in a horizontal guideway 27. This guideway 27 is fixed to the monitoring table 13 and is thus fast with the vertical column 10. Slider 26 can move the whole length of the guideway 27 by means of a pneumatic cylinder 28, whose body is fixed to the monitoring table 13 by cradles 29.

It is to be noted that the lateral ends or edges of the support 15 carry guide rollers 30 which freely turn about vertical pivot pins 31 mounted on lugs 32 belonging to the said ends or edges of the support 15.

For correctly positioning the ramming elements 14 in the shell 3 of the ladle, the gantry frame 4 is brought to a point above the shell of the ladle, which is positioned in the trench 7 on the turntable 8. The column 10 is then lowered by the action of the motor 11, and the tamping equipment is brought to the correct vertical level in the shell 3 of the ladle. The ramming apparatus, comprising the slider 26 and the ramming elements 14, is then positioned, horizontally and radially relative to the ladle shell 3, by acting on the pneumatic cylinder 28. Finally, the column 10 is slightly lowered again so as to introduce the ramming elements 14 between the ladle shell 3 and the ramming templet the ramming elements being distributed over the width of the space lying between the ladle shell 3 and the ramming templet by acting on the pneumatic cylinder 23 and possibly on the slider 26.

In this way the guide rollers 30 of the support 15 are caused to bear, on one side, against the ladle shell 3 and, on the other side, against the ramming templet, so that the guide rollers 30 can run along the ladle shell 3 and the templet in the course of rotation of the turntable 8. All these position-controlling movements are greatly assisted by the presence of the operative on the monitoring table 13. In order to ram the refractory lining material 1 of the ladle 2, the ramming elements 14 are brought to a position slightly above the base of the ladle shell 3 and close to the side wall of the shell 3. The refractory material constituting the base of the ladle 2 is then tamped. For this purpose use is made of a first metal circle 33, which is placed on the bottom of the ladle shell 3. Refractory lining material is poured into the area between the circle 33 and the side wall of the shell 3. Rotary movement, usually reciprocatory, is imparted to the turntable 8 and to the shell 3, this rotary movement either being of constant or variable speed; at the same time the ramming elements 14 are actuated. The ramming of the refractory material of the base of the ladle is then progressively continued in an analogous manner, using circles 34, 35 etc. of decreasing size until the central part of the base of the ladle is reached; the radial position of the ramming elements 14 is modified by acting on each occasion, on the pneumatic cylinder 23 and possibly on the slider 26. It is to be noted that, for lining the base of the shell 3, brick-laying can be used instead of ramming; the lining of the side wall of the ladle shell 3 is not affected by the use of a brick base.

After the base of the ladle has been dealt with, the ramming elements 14 are radially brought close to the side wall of the shell 3. The lower segments 36 of the ramming templet are then placed in position, and refractory lining material is poured into the area between these segments 36 and the side wall of the shell 3. The turntable 8 is set in movement and the refractory lining material is rammed by the ramming elements 14. Then, after the refractory lining material has been rammed around the segments 36, the second segments 37 of the templet are placed on the first segments 36, so as to define, with the side wall of the shell, another annular channel in which refractory lining material is poured, ramming then taking place again by means of the ramming elements 14. This procedure is then followed with the remaining segments of the templet until the upper edge of the side wall of the ladle shell 3 is reached.

A particularly important feature of the ramming installation described above is the presence of the monitoring table 13 very close to the tamping elements 14, this monitoring table enabling an operative, positioned on it, to initiate all the work operations and movements, and to continuously examine the process whereby the lining 1 is rammed for the purpose of visually checking the quality of compaction of the lining material 1.

It also has to be borne in mind that the above-described ramming installation may serve not only for forming the whole of the refractory lining 1 of the ladle 2, but also for repairing an existing refractory lining, which has deteriorated, in the ladle 2.

It should also be noted that the above-described ramming installation enables refractory lining material to be rammed over part of the height of the ladle, another part of the height to be bricked, and refractory lining material to be again rammed over any part of the height of the ladle which may possibly remain; also, refractory inserts of a selected quality may be rammed at specified places.

It is clear that the invention is not exclusively limited to the embodiment illustrated and that many modifications may be brought to the shape, the layout, and the constitution of certain of the elements used for carrying out the invention, subject to the provision that such modifications do not contradict the subject-matter of each of the following claims.

What is claimed is:

1. An installation for ramming the material constituting the refractory lining of a metallurgical vessel, said installation comprising:

a turntable rotating around its vetical axis at a constant or variable speed according to a generally reciprocatory rotary movement, means for coaxially mounting the shell of the metallurgical vessel on the turntable whereby said shell and said turntable can be rotated together, means for bringing the refractory material into the shell, a gantry frame movable horizontally relative to the shell, a column vertically displaceable on the gantry frame, a monitoring table carried by the column, a support fast mounted on the column under the monitoring table, an arm carried by the support and horizontally shiftable thereon, several ramming elements carried by the arm for ramming the refractory material poured into the vessel, a ramming templet used in connection with the shell.

2. An installation according to claim 1, characterised in that the arm which carries the ramming elements pivots about its own centre, and one of its ends bears against the side wall of the shell and the other end against a templet.

3. An installation according to claim 2, characterised in that the ends of the arm which carries the ramming elements bear guide rollers which can respectively roll along the side wall of the shell and along the templet.

4. An installation according to any of claims 1 to 3, characterised in that the ramming templet for the side wall of the shell comprises mutually superposed segments, which rest on the lined base and are successively mounted in the shell as the refractory lining material of the side wall is rammed.

* * * * *